US007061516B2

(12) United States Patent
Otaka et al.

(10) Patent No.: US 7,061,516 B2
(45) Date of Patent: Jun. 13, 2006

(54) THERMAL PRINTER, THERMAL PRINTING METHOD, AND THERMOSENSITIVE RECORDING MATERIAL

(75) Inventors: Hiroyuki Otaka, Saitama (JP); Tetsuya Otsuka, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 171 days.

(21) Appl. No.: 10/688,934

(22) Filed: Oct. 21, 2003

(65) Prior Publication Data

US 2004/0085433 A1 May 6, 2004

(30) Foreign Application Priority Data

Oct. 21, 2002 (JP) ..... 2002-305515
Oct. 28, 2002 (JP) ..... 2002-312052

(51) Int. Cl.
*B41J 2/325* (2006.01)

(52) U.S. Cl. ..... 347/178

(58) Field of Classification Search ..... 347/188, 347/211

See application file for complete search history.

(56) References Cited

U.S. PATENT DOCUMENTS 6,305,856 B1 10/2001 Miyazaki
6,727,932 B1 * 4/2004 Enomoto et al. ..... 347/188

FOREIGN PATENT DOCUMENTS

JP 7-061020 A 3/1995
JP 9-272217 A 10/1997

* cited by examiner

*Primary Examiner*—K. Feggins
(74) *Attorney, Agent, or Firm*—Sughrue Mion, PLLC

(57) ABSTRACT

In a color thermal printer, a thermal head has an array of heating elements, arranged in a main scan direction, for thermal recording to respectively pixels on thermosensitive recording material. The recording material is moved relative to the thermal head in a sub scan direction crosswise to the main scan direction, to record an image to the recording material according to image data. The recording material includes two lateral edges, opposed to each other, for extending in the sub scan direction. In the thermal printer, the image is recorded in a region extending to the two lateral edges on the recording material according to the image data. Density of two edge portions of the image disposed along the two lateral edges are lowered by processing the image data, to prevent occurrence of scorch on the two lateral edges.

22 Claims, 11 Drawing Sheets

LUT

| DENSITY LEVEL | NO. OF LINES FOR INHIBITING RECORDING |
|---|---|
| A | 3 |
| B | 2 |
| C | 1 |

THERMAL PRINTER, THERMAL PRINTING METHOD, AND THERMOSENSITIVE RECORDING MATERIAL

BACKGROUND OF THE INVENTION

1. Field of the Invention

The present invention relates to a thermal printer, a thermal printing method, and thermosensitive recording material. More particularly, the present invention relates to a thermal printer and a thermal printing method, in which application of heat to thermosensitive recording material can be suitably managed in view of high quality in image reproduction, and thermosensitive recording material.

2. Description Related to the Prior Art

A thermal printer is known in the art of image forming devices. A thermal head is incorporated in the thermal printer, is constituted by a heating element array of numerous heating elements arranged in a main scan direction. A thermosensitive recording material is moved in a sub scan direction perpendicular to the main scan direction, while an image is recorded to the recording material line after line. The thermal head pressurizes the recording material, and applies heat to the same, to develop color at a desired density. There is a platen roller opposed to the thermal head. The recording material is subjected to the thermal recording while nipped between the thermal head and the platen roller.

JP-A 9-272217 discloses a type of the thermal printer capable of full-width printing in which an image is recorded to the recording material in its full width without keeping a blank margin region on any of peripheral portions of the recording material. Although the recording material in use for the full-width printing has a standardized size, an error is likely to occur in the size due to a tolerable range in the precision of the slitting or cutting. In view of this situation, the heating element array in the thermal printer has a greater length than is sufficient for the standardized width of the recording material. Also, a sensor is used for detecting a lateral edge of the recording material, to specify a position in the heating element array associated with the lateral edge.

However, the recording material is squeezed between the thermal head and the platen roller. The recording material has a pair of lateral edges extending in the sub scan direction and opposed to one another. On the lateral edges in particular, heat from the thermal head is applied to the recording material in a locally concentrated manner on a tapered end of the lateral edges. There occurs a problem of locally high density and scorch due to overheat in a very small area of the tapered end on the lateral edges.

In the technique of the thermal recording, heat energy applied by the thermal head to the recording material changes if a printhead temperature of the thermal head changed incidentally. This causes changes in the density of a recorded image. JP-A 7-061020 discloses a construction for preventing such changes in the density due to changes in the temperature. The printhead temperature of the thermal head is measured, so as to control an interval of printing of the thermal head according to the printhead temperature. Thus, heat energy applied by the thermal head to the recording material is corrected.

However, the temperature of the recording material also influences the heat energy applied to the recording material. There occurs a problem in low quality in recording an image because of the influence of the temperature of the recording material. There is no known technique of considering the temperature of the recording material for keeping quality of image recording.

SUMMARY OF THE INVENTION

In view of the foregoing problems, an object of the present invention is to provide a thermal printer and a thermal printing method, in which application of heat to thermosensitive recording material can be suitably managed in view of high quality in image reproduction, and thermosensitive recording material.

Another object of the present invention is to provide a thermal printer and a thermal printing method capable of producing a full-width print without blank margins reliably with high quality.

In order to achieve the above and other objects and advantages of this invention, a thermal printing method is provided, in which a thermal head is used and has a heating element array of plural heating elements, arranged in a main scan direction, for thermal recording to respectively pixels on thermosensitive recording material. A first one of a thermal head and the recording material is moved relative to a second one thereof in a sub scan direction crosswise to the main scan direction, to record an image to the recording material according to image data, the recording material includes first and second lateral edges, opposed to each other, for extending in the sub scan direction. In the thermal printing method, the image is recorded in a region extending to at least the first lateral edge on the recording material according to the image data. Density of a first edge portion of the image disposed along the first lateral edge is lowered by processing the image data, in order to prevent occurrence of scorch on the first lateral edge.

A thermal printer includes a thermal head having a heating element array of plural heating elements, arranged in a main scan direction, for thermal recording to respectively pixels on thermosensitive recording material, a moving mechanism for moving a first one of the thermal head and the recording material relative to a second one thereof in a sub scan direction crosswise to the main scan direction, to record an image to the recording material according to image data, wherein the recording material includes first and second lateral edges, opposed to each other, for extending in the sub scan direction. The thermal printer comprises a frame memory for storing the image data. A printing data generator generates printing data by processing the image data, the printing data being adapted to driving the thermal head, for recording the image in a region extending to at least the first lateral edge on the recording material, the printing data being formed with lowered density in a first edge portion of the image disposed along the first lateral edge, in order to prevent occurrence of scorch on the first lateral edge.

The printing data is formed further with lowered density in a second edge portion of the image disposed along the second lateral edge. The printing data generator thins data portions of at least one line per N lines of the pixels in the image data in relation to the first and second edge portions, and N is an integer of 2 or more.

Furthermore, an edge detecting sensor detects a position of the first lateral edge in the main scan direction. A controller determines heating elements associated with the first edge portion among the plural heating elements according to a signal from the edge detecting sensor.

Furthermore, a position regulating mechanism contacts and regulates the second lateral edge with respect to the main scan direction, to guide the second lateral edge on a predetermined guide line extending in the sub scan direction. Heating elements included in the plural heating elements and corresponding to the second edge portion are disposed directly inside the guide line.

Furthermore, a bias mechanism presses the first lateral edge toward the position regulating mechanism, to regulate movement of the recording material with the position regulating mechanism.

Furthermore, a line memory stores line image data of respectively plural lines read according to the image data. The printing data generator includes a table memory for storing information of line groups each of which has N lines, and information of at least one particular line included in the N lines. A printing data memory stores line printing data of each of the plural lines, wherein the line printing data is used to drive the thermal head to record a line image, and if a line to be recorded is the particular line, has a form according to the line image data and to enable recording of pixels of the line and inside the first and second edge portions, and if the line to be recorded is different from the particular line, has a form according to the line image data and to disable recording of the pixels of the line and inside the first and second edge portions.

The edge detecting sensor includes plural photoreceptor elements, arranged in the main scan direction in an array, for photoelectrically detecting light incident thereon, and the position of the first lateral edge is retrieved among the photoreceptor elements between one thereof where bright light is incident and one thereof where dim light is incident.

Furthermore, a light projector projects light of inspection toward the plural photoreceptor elements, the recording material is movable between the light projector and the array of the photoreceptor elements.

Furthermore, N=2.

Each of the first and second portions is constituted by 3–9 pixels as viewed in the main scan direction.

Furthermore, a density level table memory stores information of line number p with an address of information of a low density level, and information of line number q with an address of information of a high density level, where p and q satisfy $1<p<q<N$. The printing data generator determines at which of the low and high density levels edge density of the first and second edge portions is according to the image data by comparison with at least one threshold density, and if the edge density is at the low density level, thins pixels of p lines per the N lines, and if the edge density is at the high density level, thins pixels of q lines per the N lines.

Furthermore, an image data analyzer determines an average of density of pixels in the first and second edge portions according to the image data, to obtain the edge density.

The heating element array includes outer heating elements disposed outside the first lateral edge, and the controller suppresses driving of the outer heating elements.

According to one aspect of the invention, a thermal printer in which thermosensitive recording material is used includes a thermal head for thermal recording to the recording material. A controller receives temperature data of material temperature of the recording material from a recording material temperature sensor, and controls the thermal head according thereto.

The recording material includes a material body for developing color upon being heated. The recording material temperature sensor is secured to the material body, for detecting the material temperature.

Furthermore, a printhead temperature sensor detects a printhead temperature of the thermal head. The controller further receives data of the printhead temperature from the printhead temperature sensor, to control the thermal head according thereto.

The recording material further includes a data transmitter for wirelessly transmitting the temperature data from the recording material temperature sensor. Furthermore, a data receiver receives the temperature data from the data transmitter, to supply the controller therewith.

The data transmitter and the data receiver are constituted by wireless tags.

The recording material temperature sensor is secured to an edge region of the recording material and extending along one edge thereof.

Furthermore, a moving mechanism moves the recording material relative to the thermal head in a moving direction, for thermal recording to the recording material. The recording material includes a printing region for thermal recording, and the edge region is positioned downstream from the printing region in the moving direction.

In one preferred embodiment, furthermore, a moving mechanism moves the recording material relative to the thermal head in a moving direction, for thermal recording to the recording material. The one edge extends in the moving direction.

According to one aspect of the invention, a printhead temperature correcting method of a thermal head for thermal recording to thermosensitive recording material is provided. In the printhead temperature correcting method, material temperature of the recording material is detected. The thermal head is controlled according to the material temperature, to prevent the material temperature from influencing density of thermal recording.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
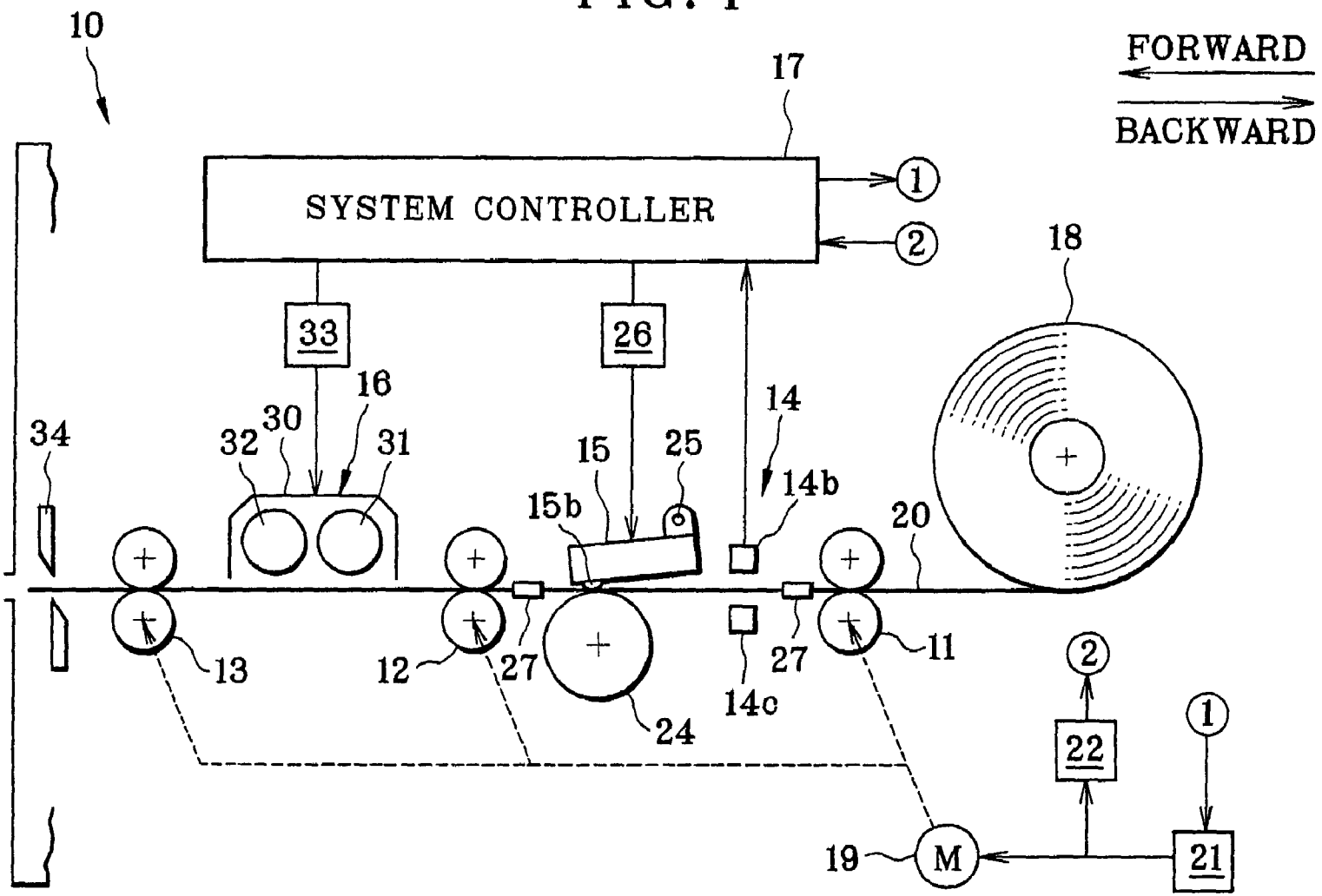
FIG. 1 is an explanatory view illustrating a color thermal printer.

In FIG. 1, a color thermal printer 10 of the invention is illustrated. The color thermal printer 10 is constituted by a first feed roller set 11, a second feed roller set 12, a third feed roller set 13, an edge detecting line sensor 14, a thermal head 15, a photo fixer 16, and a system controller 17. A recording material roll 18 is loaded in the color thermal printer 10, and is constituted by a color thermosensitive recording material 20 wound in a roll form. A stepping motor 19 causes the feed roller sets 11, 12 and 13 as a moving mechanism to rotate in both of forward and backward directions, to move the recording material 20 back and forth after unwinding from the recording material roll 18 to a feeding path. A motor driver 21 is connected with the system controller 17, which controls rotation of the stepping motor 19. Note that a basic example of the color thermal printer 10 is such as disclosed in U.S. Pat. No. 6,305,856.

Drive pulses are sent to the stepping motor 19. A pulse counter 22 counts the drive pulses. The system controller 17 receives a counted result of the pulse counter 22, and determines a start position of starting printing, a return position of returning the recording material 20, a cutting position of cutting the recording material 20, and the like. The pulse counter 22, while the stepping motor 19 rotates forwards, counts the drive pulses incrementally, and while the stepping motor 19 rotates backwards, counts the drive pulses decrementally.

The recording material 20 includes a support and cyan, magenta and yellow thermosensitive coloring layers. The yellow coloring layer has the highest sensitivity to heat, and develops a yellow color in response to heat energy of a comparatively low level. The cyan coloring layer has the lowest sensitivity to heat, and develops a cyan color in response to heat energy of a comparatively high level. When visible violet rays are applied to the recording material 20 at a wavelength with a peak of approximately 420 nm, coloring ability of the yellow coloring layer is destroyed. The magenta coloring layer develops a magenta color in response to heat energy at a level between the levels for the yellow and cyan coloring layers. When near ultraviolet rays are applied to the recording material 20 at a wavelength with a peak of approximately 365 nm, coloring ability of the magenta coloring layer is destroyed.

Figure 2:
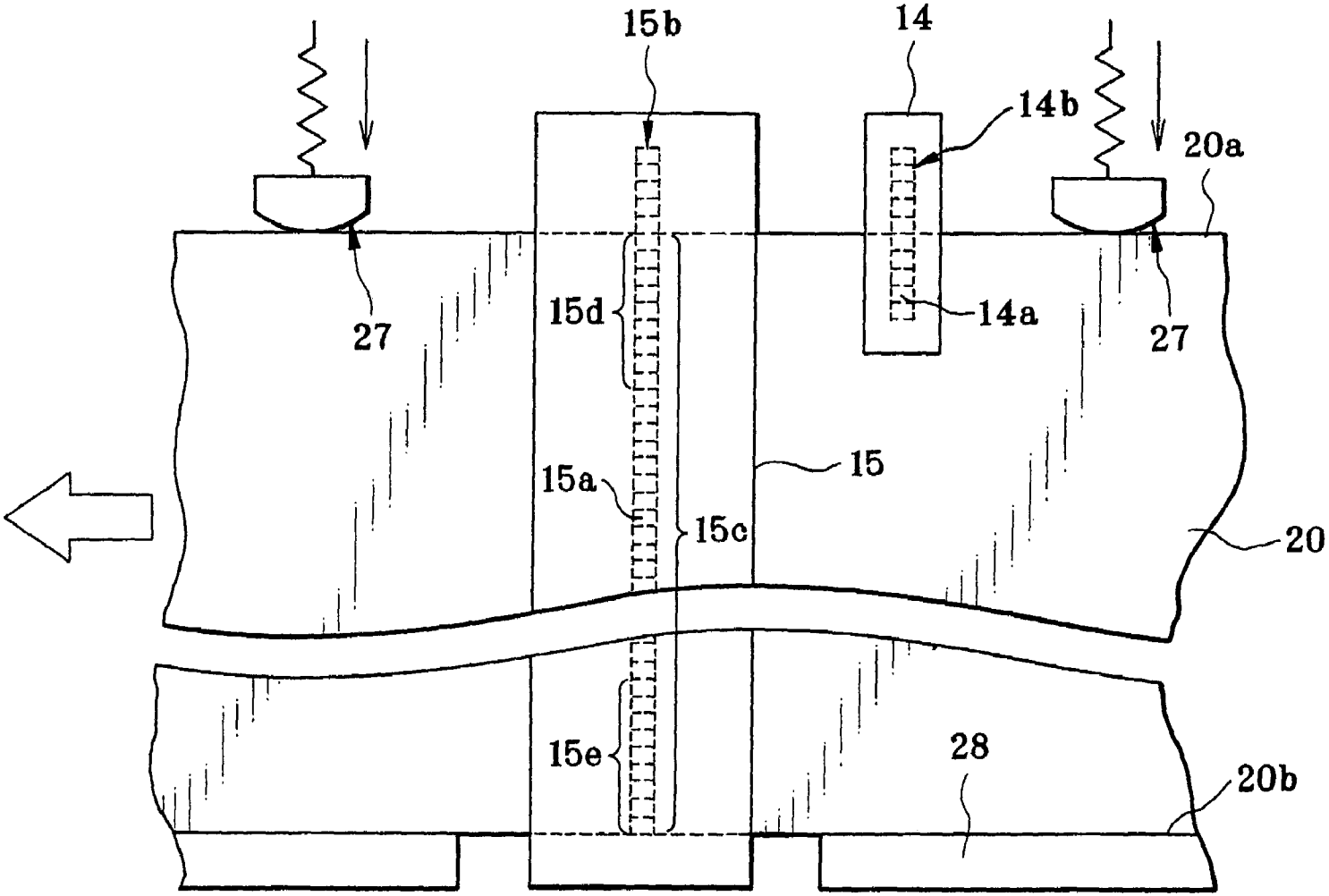
FIG. 2 is an explanatory view in plan, illustrating elements in the thermal printer including a thermal head and an edge detecting sensor.

The thermal head 15 is disposed between the feed roller sets 11 and 12. As illustrated in FIG. 2, a heating element array 15*b* constitutes the thermal head 15, and includes heating elements 15*a* arranged in a main scan direction. The heating element array 15*b* extends at a length greater than a standard width of the recording material 20. If the recording material 20 in use incidentally has a width slightly greater than the standard width predetermined according to its type, it is possible to record an image to the recording material 20 in a full-width manner without creating blank margins.

A platen roller 24 is disposed so that the feeding path for the recording material 20 lies between the same and the heating element array 15*b*, and supports the recording material 20. There is a pivot 25 about which the thermal head 15 is rotationally movable between a printing position and an offset position. The thermal head 15, when in the printing position, presses the recording material 20 on the platen roller 24, and when in the offset position, comes up away from the platen roller 24. The platen roller 24 keeps the contact on a back surface of the recording material 20 while the thermal head 15 applies pressure thereto, and is caused to rotate by movement of the recording material 20, to keep stability in the contact between the recording material 20 and the heating element array 15*b*. An image is thermally recorded to the recording material 20 in a state pressurized between the thermal head and the platen roller 24.

A printhead driver 26 is connected with the thermal head 15, and when the recording material 20 is moved in the forward direction, is caused by the system controller 17 to control the thermal head 15. This control drives the heating elements 15*a* in the heating element array 15*b* to generate heat at a certain temperature determined according to the printing data as will be described in detail. Heat energy is applied by the heating elements 15*a* to the recording material 20 to develop colors in the coloring layers selectively.

A bias mechanism 27 with a spring is disposed close to the thermal head 15, and pushes a first lateral edge 20*a* of the recording material 20. A second lateral edge 20*b* of the recording material 20 is kept in contact with a guide portion 28 or position regulating mechanism by the force of the bias mechanism 27. The thermal head 15 is so disposed that one end of the heating element array 15*b* is opposed always to the second lateral edge 20*b*.

The edge detecting line sensor 14 is positioned upstream from the thermal head 15, and disposed to face the first lateral edge 20*a* of the recording material 20. The edge detecting line sensor 14 detects a position of the first lateral edge 20*a* of the recording material 20 photoelectrically, and sends the system controller 17 data of the position of the first lateral edge 20*a*. Also, the edge detecting line sensor 14 is effective as a front edge detector to detect a front edge of the recording material 20. The system controller 17 receives a front edge detection signal from the edge detecting line sensor 14, and responsively starts counting drive pulses sent to the stepping motor 19, and controls a positioned state and moving amount of the recording material 20 until the end of the printing operation.

In FIG. 2, the edge detecting line sensor 14 has a photoreceptor array 14*b* including plural photoreceptor elements 14*a*, such as CCD elements, arranged at a pitch equal to that of the heating elements 15*a*. There is a light projector 14*c* opposed to the photoreceptor array 14*b*. When the recording material 20 moves past the photoreceptor array 14*b*, the light from the light projector 14*c* is partially intercepted, so there occurs a change in a state of receiving the light in the photoreceptor elements 14*a*. The system controller 17 receives detection signals from the photoreceptor elements 14*a*, and determines a position of the first lateral edge 20*a*. It is to be noted that the edge detecting line sensor 14 may be a reflection type of sensor in which light is projected to the recording material 20, and the light reflected by the recording material 20 is received to detect the position of the first lateral edge 20*a*.

The photo fixer 16 includes a yellow fixing lamp 31, a magenta fixing lamp 32 and a reflector 30. The yellow fixing lamp 31 emits the specific electromagnetic rays for the yellow fixation. The magenta fixing lamp 32 emits the specific electromagnetic rays for the magenta fixation. A fixer driver 33 is caused by the system controller 17 to turn on the fixing lamps 31 and 32 for destruction of the coloring ability of the yellow and magenta coloring layers by the photo fixation.

A cutter 34 is positioned downstream from the photo fixer 16. When the printing and fixation of the recording material

20 are completed, a printed portion of the recording material 20 is moved to the cutter 34. The cutter 34 cuts away a front margin of the recording material 20, and also the printed portion of the recording material 20 in a sheet form. The cut sheet of the printed portion is ejected to the outside of the color thermal printer 10. A unused portion of the recording material 20 before the printing is wound back to the recording material roll 18.

Figure 3:
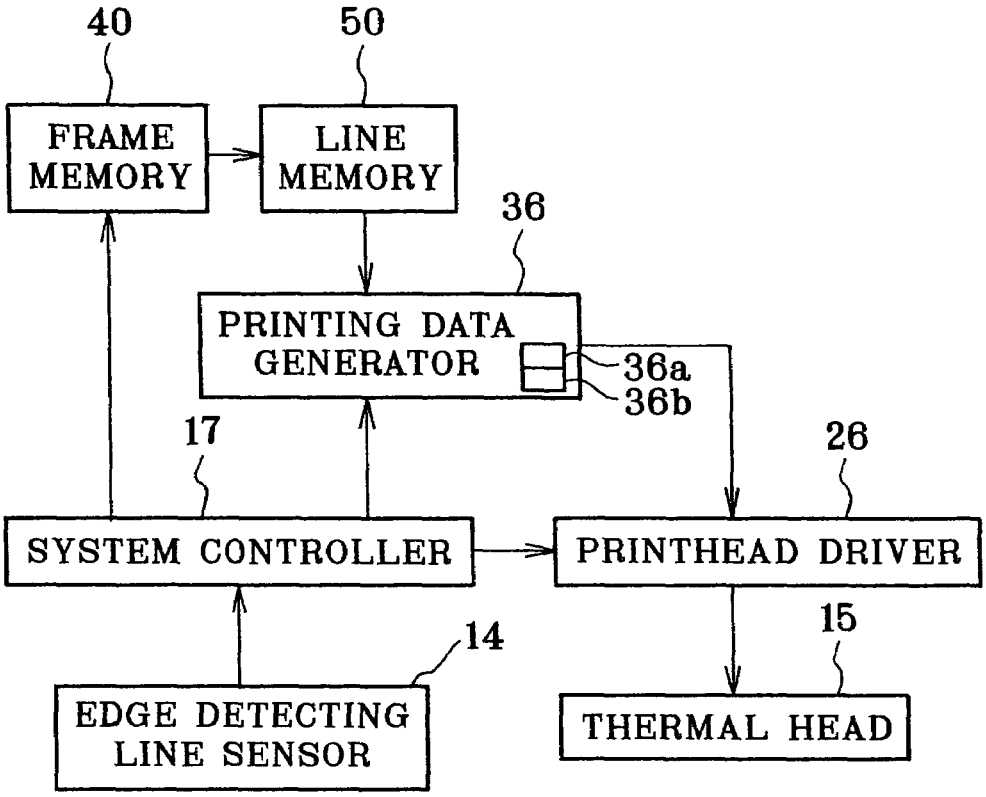
FIG. 3 is a block diagram schematically illustrating the thermal printer.

In FIG. 3, electric circuits in the color thermal printer 10 are schematically illustrated. Various elements are connected with the system controller 17, including the edge detecting line sensor 14, the printhead driver 26, and also a printing data generator 36 and a frame memory 40.

An I/O port (not shown) is included in the color thermal printer 10 for connection of external equipments of various types. An I/O circuit is connected with the I/O port. The I/O circuit is supplied with image data of three colors of red, green and blue by the equipment connected with the I/O port, such as a digital camera, personal computer and the like. The image data is sent by means of the I/O circuit, and written to the frame memory 40.

The system controller 17 evaluates the lateral edge position data, and determines a central group of heating elements 15*c*, and edge region heating elements 15*d* and 15*e*. See FIG. 2. The central group of heating elements 15*c* are included in the heating element array 15*b*, and opposed to the recording material 20 between the lateral edges 20*a* and 20*b*. The edge region heating elements 15*d* are included in the central group of heating elements 15*c*, and located in the vicinity of the first lateral edge 20*a*. The edge region heating elements 15*e* are included in the central group of heating elements 15*c*, and located in the vicinity of the second lateral edge 20*b*.

The number of the heating elements 15*a* constituting the edge region heating elements 15*d* and 15*e* is suitably predetermined according to the size of the heating elements 15*a*, the pitch of arrangement of the heating elements 15*a* and the like. Should the number of the heating elements 15*a* be too small, it will be necessary to raise precision in the detection of the first lateral edge 20*a* of the recording material 20. This is likely to raise a manufacturing cost due to a need of a line sensor with very high quality. In contrast, should the number be too great, it will result in a conspicuously degraded edge portion with too low a density in the color. It follows that the number of the edge region heating elements 15*d* and 15*e* is preferably in a range of 3–9.

Figure 4:
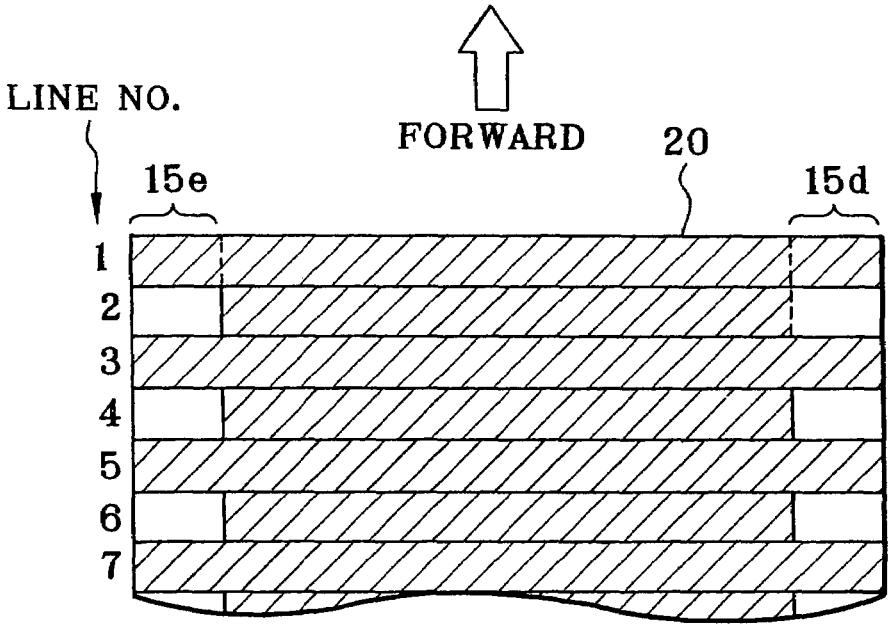
FIG. 4 is an explanatory view in plan, illustrating regions of edge portion pixels.

As has been described heretofore, density of recording is likely to be locally high on the lateral edges 20*a* and 20*b* of the recording material 20, because heat from the thermal head 15 is applied to narrow end surfaces of the recording material 20. For the purpose of preventing occurrence of scorch due to the local overheat, the system controller 17 operates as illustrated in FIG. 4 to control the thermal head 15 for printing with the edge region heating elements 15*d* and 15*e* only on one line regularly per two lines. This is effective in suppressing extreme rise in the density over the desired density. For example, if a line number of a line is odd, one line image is fully recorded. If a line number is even, one line image is recorded only partially by suppressing recording of edge portion pixels located in the vicinity of the lateral edges 20*a* and 20*b*. It is of course possible to suppress recording of the edge portion pixels at the odd line numbers, and fully to record a line image at the even line numbers.

There is a line memory 50. The image data is read from the frame memory 40 by one line, and written to the line memory 50 for each of the three colors line by line. The printing data generator 36 creates printing data for driving the heating elements 15*a* according to the image data written to the line memory 50.

The printing data generator 36 is controlled upon a command signal generated by the system controller 17, and produces printing data assigned to the heating elements 15*a* included in the central group of heating elements 15*c*. The printing data generator 36 corrects the received image data for one line regularly per two lines to thin the recording with the edge region heating elements 15*d* and 15*e*, so as to produce and output the printing data.

A table memory 36*a* is included in the printing data generator 36, and stores table data which is read at an address of each of the line numbers of the numerous lines in the image, to output data of one of odd and even numbers. A printing data memory 36*b* stores the printing data obtained after the correcting operation.

The printing data after the correction or compensation is sent to the printhead driver 26. The printhead driver 26 is controlled by the system controller 17, causes the heating elements 15*a* in the thermal head 15 to generate heat according to the printing data, to record an image to the recording material 20 thermally. The edge portion pixels are recorded in one line per two lines. The average density in the portions of the lateral edges 20*a* and 20*b* is lowered, to prevent partial overheating and occurrence of scorch.

Figure 5:
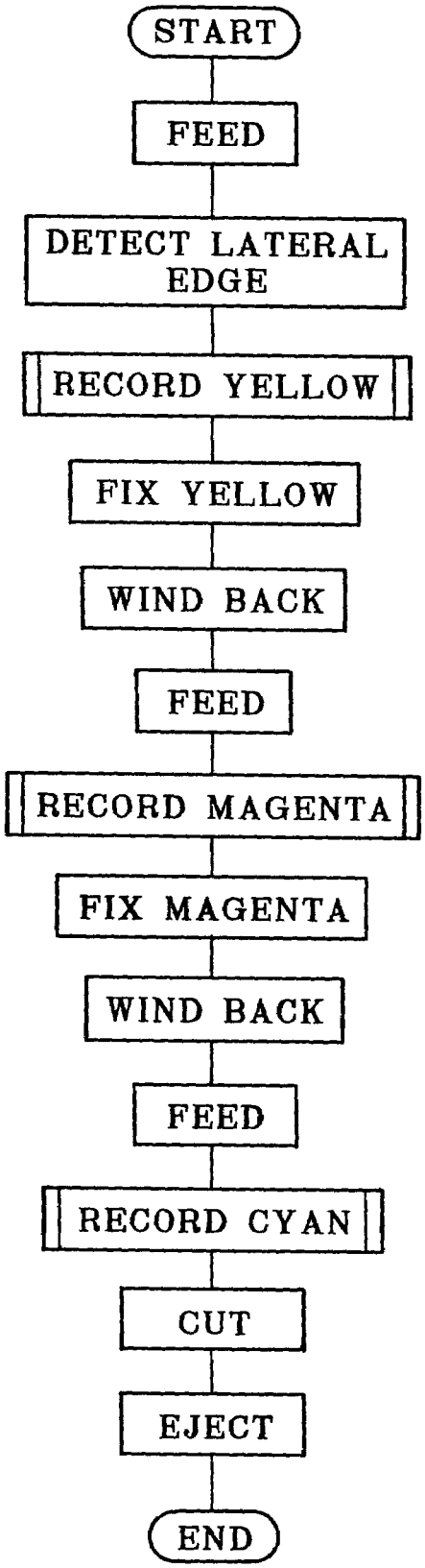
FIG. 5 is a flow chart illustrating a printing process.
Figure 6:
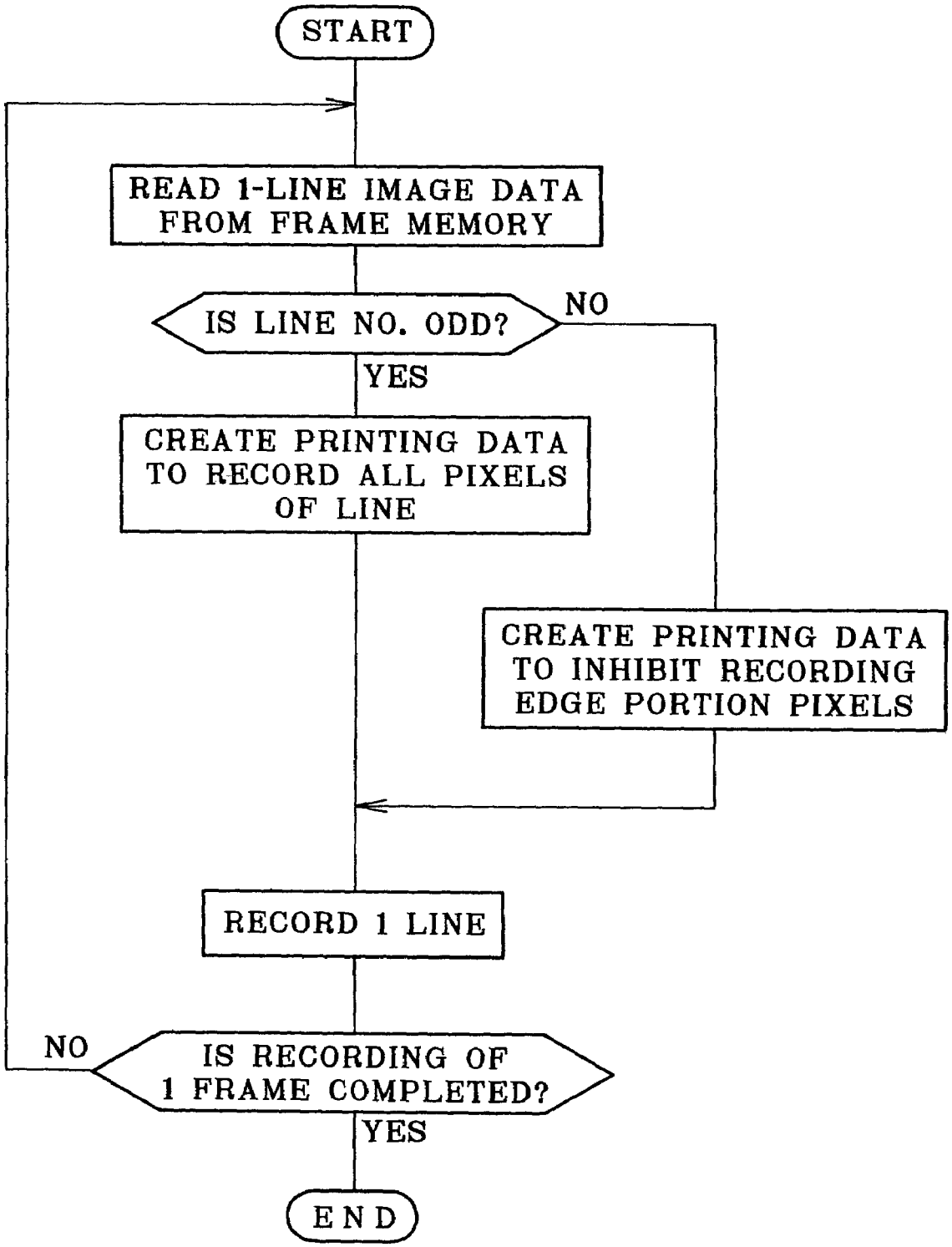
FIG. 6 is a flow chart illustrating a process of driving the thermal head.

The operation of the above construction is described by referring to FIGS. 5 and 6. To produce a print from the recording material 20 by use of the color thermal printer 10, at first an external device is connected with the color thermal printer 10 by a communication cable, such as a digital camera, computer or the like. One image to be printed is selected. A command signal for printing is input to the color thermal printer 10, to start the printing operation.

Image data of a designated image is input to the color thermal printer 10 by means of the I/O circuit, and written to the frame memory 40 for each of the three colors. After this, the system controller 17 causes the motor driver 21 to rotate the stepping motor 19 in the forward direction. The stepping motor 19 causes the feed roller sets 11, 12 and 13 to rotate in the forward direction, to move the recording material 20 forwards for feeding. The thermal head 15 is set in the offset position not to block the recording material 20 in the movement. The pressure of the bias mechanism 27 keeps the second lateral edge 20*b* of the recording material 20 in contact with the guide portion 28 while the recording material 20 is moved.

When the recording material 20 reaches the edge detecting line sensor 14, the edge detecting line sensor 14 detects a position of the first lateral edge 20*a* of the recording material 20, and sends lateral edge position data to the system controller 17. Also, the system controller 17 starts counting the drive pulses that are input to the stepping motor 19. According to the lateral edge position data, the system controller 17 specifies the edge region heating elements 15*d* as well as the edge region heating elements 15*e*. Data of the specified locations of the edge region heating elements 15*d* and 15*e* are sent to the printing data generator 36.

When a front edge of a printing region of the recording material 20 moves and reaches the heating element array 15*b*, the thermal head 15 is shifted to the printing position. In FIG. 6, a flow of the printing operation is depicted. According to this, yellow recording is started with the thermal head 15. The image data is read from the frame memory 40, and written to the line memory 50 line after line.

The printing data generator 36 reads line image data of one line from the line memory 50, and produces printing data. If the line number of the line is odd, line printing data is produced in a form to print all of the pixels of the line. If the line number of the line is even, the line image data of the line is corrected to suppress printing of the edge portion pixels, to produce line printing data. According to the printing data of a frame created by the printing data generator 36, the thermal head 15 is driven to record the image one line after another. After printing of a first line, the recording material 20 is moved forward by an amount of one line. Similarly, printing data is produced according to this process, to record a second line image. The operation of the line image recording is repeatedly effected until an image of one frame is recorded. As illustrated in FIG. 4, the edge portion pixels are thinned regularly for one line per two lines. Thus, occurrence of scorch can be suppressed.

At the end of the yellow recording, the recorded portion of the recording material 20 is moved to the photo fixer 16 serially, and subjected to the yellow fixation. After this, the unwound portion of the recording material 20 is wound back. The front edge of the printing region comes again to the thermal head 15. In response to this, the recording material 20 starts being moved in the forward direction, to record the magenta color thermally.

The magenta recording is effected according to the process in FIG. 6 similarly to the yellow recording. After the magenta recording, the magenta color is fixed by the photo fixation. The recording material 20 is moved backwards, before a cyan color is recorded. The cyan recording is effected according to the process in FIG. 6 similarly to the magenta recording. After this, a recorded portion of the recording material 20 is moved to the cutter, which cuts the same from the recording material 20 in a sheet form. A print is obtained, and ejected.

In the above embodiments, the edge portion pixels are recorded in one line per two lines. However, it is possible according to the invention to use alternation of two steps that include a first step of recording of one line, and a second step of suppressing recording of two or more lines. Namely, one line per three lines or more may be recorded at the edge portin pixels. In spite of the above-described feature of the invention, it is likely that scorch occurs should the density of an image be very high, and that a degraded portion with too thin a color occurs should the density be very low. It is preferable to use a construction of adjusting the number of lines for suppression of the recording according to the high or low state of the density of the edge portion pixels.

Figure 7:
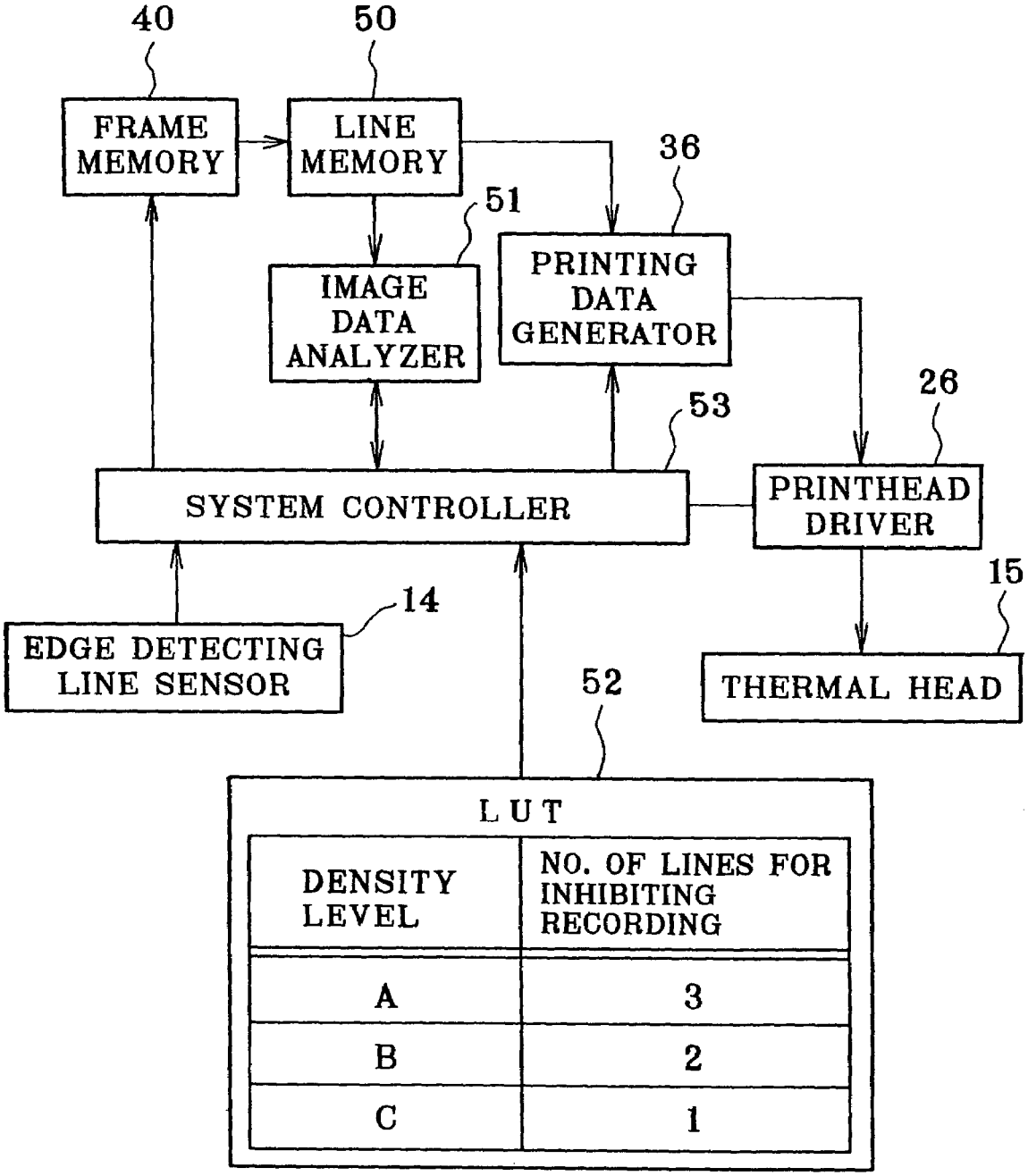
FIG. 7 is a block diagram schematically illustrating another preferred thermal printer in which high or low density of an image is considered.
Figure 8:
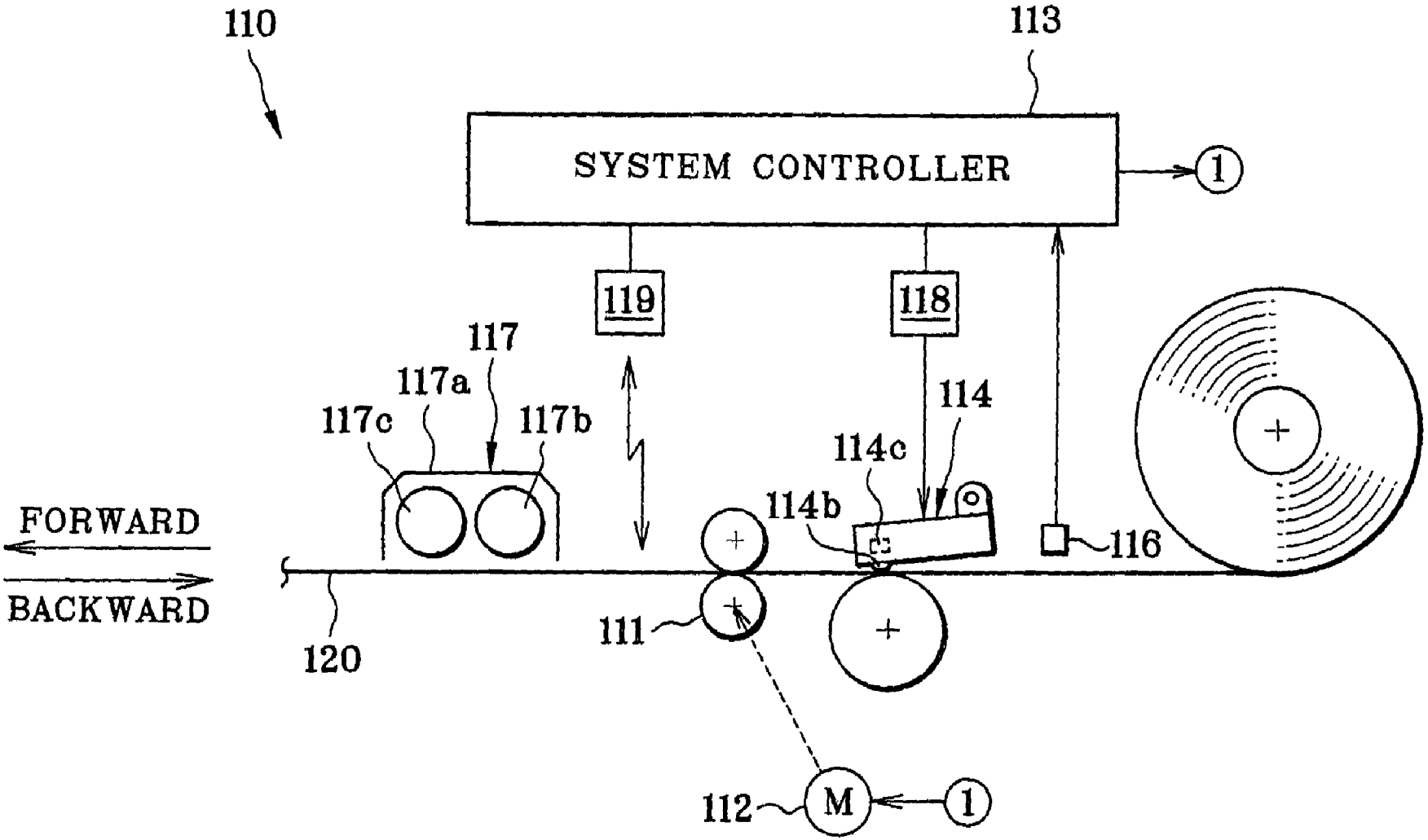
FIG. 8 is an explanatory view illustrating still another preferred thermal printer in which influence of temperature is considered.

For this purpose, an image data analyzer 51 and a density level lookup table memory (LUT) 52 are used as illustrated in FIG. 7. The image data analyzer 51 analyzes the image data being input, and analyzes high or low density of edge portion pixels of an image according to the image data. The density level LUT 52 stores table data which is constituted by values of an interval of printing, and ranks or grades of the image density combined with the values of the interval. An example of a set of ranks or grades of the image density includes a high density of rank A, an intermediate density of rank B, and a low density of rank C. With each of the ranks, intervals of printing are predetermined and combined.

The image data analyzer 51 reads all the lines for the edge portion pixels, determines average density of the edge portion pixels, and evaluates the average density. A system controller 53 accesses the density level LUT 52, and checks in which of the ranks the average density falls, so as to determine the number of the lines where recording is inhibited. If the average density is in the range of rank A with the high density, then the number of the lines for the inhibition is determined as three (3). If the average density is in the range of rank C with the low density, then the number of the line for the inhibition is determined as one (1). Furthermore, it is possible that one or more changes in the number of the lines for the inhibition are determined during recording of one frame. This is effective in considering local changes in the high or low density included in the one image. The image can be printed with higher quality.

It is to be noted that, instead of using the density level LUT 52, a set of plural comparators may be used for evaluating data of the density levels in the three ranks or more.

In the present invention, the at least one line where the coloring of the edge region is suppressed can be constituted of M2 adjacent lines which may be next to M1 adjacent lines, where M1 is an integer of at least two, and M2 is an integer of at least one. M1 and M2 are determined according to average density in a region in the image associated with the edge region heating element. Alternatively, it is possible that M1 and M2 are determined according to average density in a portion in the image included in a region associated with the edge region heating element.

In the above embodiments, the color thermal printer is a type specialized for the full-width printing without forming blank margins. However, a thermal printer according to the invention may be a printer capable of producing a normal print with blank margins at a small width, and a full-width print without blank margins. A selection input panel may be used to determine one of the two modes for the printing with or without blank margins.

In the above embodiments, the second lateral edge 20*b* of the recording material 20 is guided by the guide portion 28. The first lateral edge 20*a* is detected by the edge detecting line sensor 14, so as to specify the edge region heating elements 15*d* and 15*e* associated with the lateral edges 20*a* and 20*b* of the recording material 20. However, a plurality of the edge detecting line sensors 14 may be used to detect respectively the lateral edges 20*a* and 20*b* of the recording material 20 for the purpose of specifying edge portion heating elements. In the above embodiments, the first lateral edge 20*a* of the recording material 20 is detected for one time by the edge detecting line sensor 14 in the course of feeding. However, the edge detecting line sensor 14 may detect the first lateral edge 20*a* for three times for respectively the three colors.

In the above embodiments, the recording material 20 in a continuous form with a great length is used for printing an image. However, a recording material may be a recording sheet of a limited size in a sheet form.

In the above embodiments, the color thermal printer includes the single thermal head for the three colors. However, plural thermal heads, for example three, may be used to produce a full-color print by one-time feeding of the recording material 20.

In the present invention, the color thermal printer 10 is suitable for producing a full-width print without blank margin regions. In general, it is possible to use recording material in at least one standardized size for the purpose of the full-width printing. Thus, width information of the recording material is predetermined. In a state shipped from a manufacturing factory, the recording material as a product cannot have a precisely exact width as expected. Small changes are inevitable in a tolerable range which is preset according to the industrial standards or a manufacturer s certain standards of keeping quality of products.

If the recording material 20 has a smaller width than the standard width, there occurs a belt-shaped elimination of the image along the first lateral edge 20*a* on the side of the edge detecting line sensor 14 if the printing data of the standard width is used for recording. In view of this, it is preferable to set the center of the image at the center of the sheet. The width of the recording material 20 is calculated according to a detection signal of the edge detecting line sensor 14, to obtain a width difference by subtracting the calculated width from the standard width, and to shift the printing data by a half of the width difference toward the second lateral edge 20*b*, for the purpose of supplying the thermal head with the printing data. This is effective in symmetrizing the belt-shaped elimination of the image along both of the lateral edges 20*a* and 20*b*, so as to produce a full-width print of a suitable form.

Note that, if the width difference is remarkably small in the case of the smaller width of the recording material 20, a belt-shaped elimination of the image along the first lateral edge 20*a* on the side of the edge detecting line sensor 14 can be extremely small. Therefore, shifting of the printing data can be omitted. A full-width print can be produced suitably even without modifying the original printing data.

Furthermore, it is possible finely to adjust the size of the image according to the recording material width. If the material width is greater than the standard width, the image size is enlarged. To this end, processing of a proportional enlargement or interpolation can be used. If the material width is smaller than the standard width, the image size is reduced. To this end, processing of a proportional reduction or thinning can be used.

In the above embodiments, supply of heat energy is allowed to the central group of heating elements 15*c* opposed to the recording material 20. To those among the heating elements 15*a* offset from the recording material 20, supply of heat energy is inhibited, or only heat energy short of a level of bias heat energy enough to coloring at a minimum density is applied. However, supply of imaging heat energy can be used for one heating element or a small number of heating elements outside the first or second lateral edge 20*a* or 20*b* of the recording material 20 among the heating elements 15*a* for the purpose of the full-width printing with high reliability without even a small blank margin. On the side of the guide portion 28, the thermal head 15 can be elongated outside the reference line at an amount of one heating element or a small number of heating elements. According to such structures, it is possible to produce a print without much failure even if there occurs temporary unevenness in the movement of the recording material 20.

Two edge detecting line sensors 14 may be used for the first and second lateral edges 20*a* and 20*b*. With this structure, it is also possible to lower the precision for the bias mechanism 27 and the guide portion 28 in an auxiliary and loose manner in operation of the regulation. The recording material 20 may be guided by this loose structure with substantially great play without exact positioning of the biasing force. Furthermore, it is possible instead of the bias mechanism 27 and the guide portion 28 to use a slidable guide mechanism, which can be adjusted by manual operation.

Figure 9:
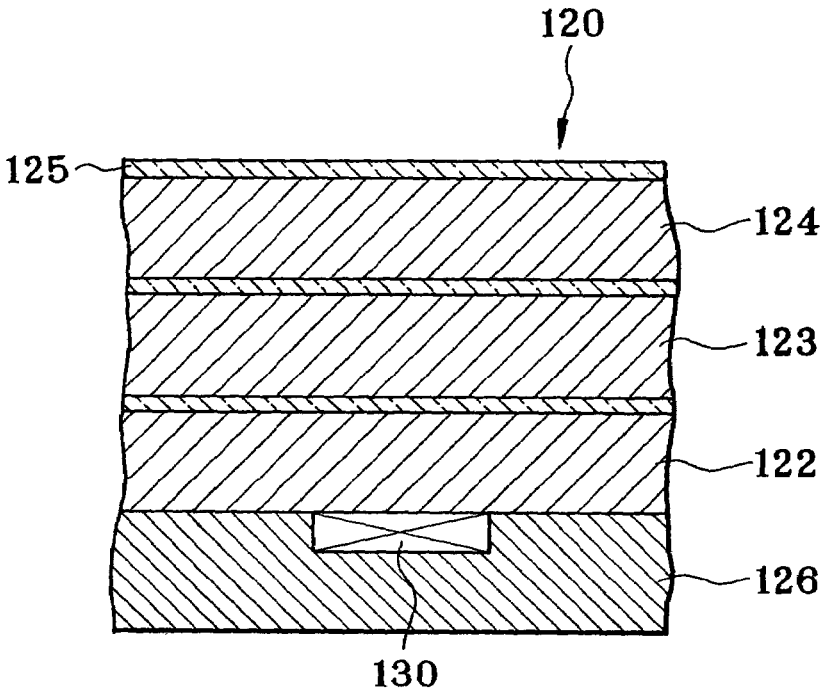
FIG. 9 is a cross section, partially broken, illustrating a disposition of a recording material temperature sensor.

One preferred embodiment in which temperature of the recording material is considered in driving the heating elements is described with reference to FIGS. 8–12. In FIG. 9, color thermosensitive recording material 120 includes a support 126, a cyan recording layer 122, a magenta recording layer 123, a yellow recording layer 124 and a transparent protective layer 125 overlaid in sequence over one another.

Figure 10:
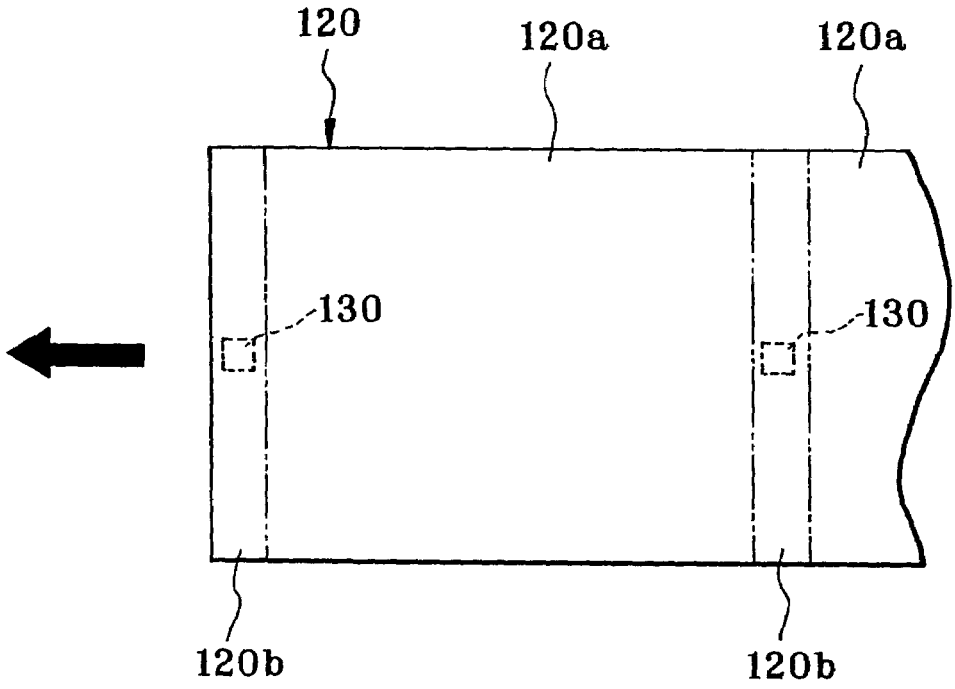
FIG. 10 is a plan, partially broken, illustrating the disposition of the recording material temperature sensor.

A thermometer unit 130 is incorporated in the support 126 between its sheet layers for measuring temperature of the recording material 120. A color thermal printer 110 includes a system controller 113. The thermometer unit 130 wirelessly transmits temperature data of the material temperature of the recording material 120 to the system controller 113. The recording material 120 has a printing region 120*a* and a front edge region 120*b* or margin positioned downstream from the printing region 120*a*. As depicted in FIG. 10, the thermometer unit 130 is contained in the front edge region 120*b*. The front edge region 120*b* is cut away by a cutter and discarded after the printing operation to the printing region 120*a* is completed.

There is a thermal head 114, in which a printhead temperature sensor 114*c* is incorporated for measuring the temperature of the thermal head 114. When the temperature of at least one of the thermal head 114 and the recording material 120 changes, heat energy generated by the thermal head 114 changes. Thus, a voltage applied to the thermal head 114 is adjusted by correction according to the printhead temperature obtained by the printhead temperature sensor 114*c* and the material temperature obtained by the thermometer unit 130. This is effective in correcting the heat energy of the thermal head 114, so as to prevent changes in the density due to the changes in the temperature.

A front edge sensor 116 is positioned upstream from the thermal head 114 according to the forward direction. The front edge sensor 116 detects a front edge of the recording material 120, and provides the system controller 113 with a detection signal. A stepping motor 112 for the purpose of feeding is supplied with drive pulses. In response to the detection signal from the front edge sensor 116, the system controller 113 starts counting the drive pulses to the stepping motor 112, and controls the position and moving amount of the recording material 120 until the end of the printing.

A photo fixer 117 is positioned downstream from a feed roller set 111 as moving mechanism. The photo fixer 117 includes a yellow fixing lamp 117*b*, a magenta fixing lamp 117*c* and a reflector 117*a*.

Figure 11:
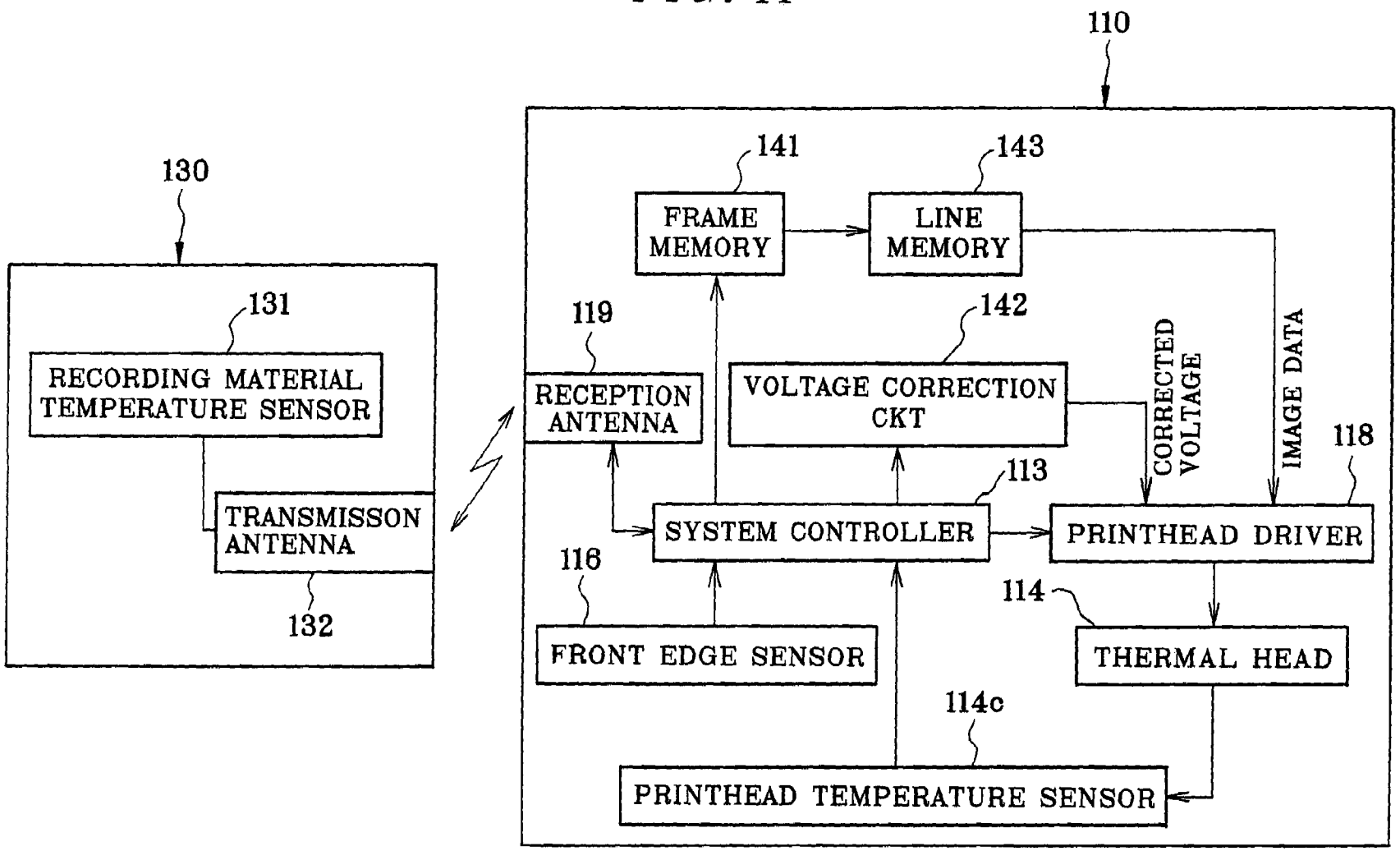
FIG. 11 is a block diagram schematically illustrating the thermal printer in combination with the recording material temperature sensor.

In FIG. 11, relevant circuits in the color thermal printer 110 and the thermometer unit 130 are schematically illustrated. The system controller 113 generally controls sections included in the color thermal printer 110. The various elements are connected with the system controller 113, including the front edge sensor 116, the printhead temperature sensor 114*c*, a printhead driver 118, a wireless tag reception antenna 119 as data receiver, a frame memory 141 and a voltage correction circuit 142.

The voltage correction circuit 142 corrects the printhead voltage according to the printhead temperature measured by the printhead temperature sensor 114*c* and the material temperature measured by the thermometer unit 130. Data of a level of the corrected voltage is input to the printhead driver 118.

The printhead driver 118 drives the thermal head 114 according to the image data and the corrected voltage. The printhead driver 118 applies a printhead voltage to the thermal head 114 at a level depending on the corrected voltage. A set of drive pulses associated with pixel density is created according to the image data, and sent to the thermal head 114 to which the printhead voltage is being applied. The adjustment of the printhead voltage can adjust the heat energy generated by each of the heating elements. Note that, instead of adjusting the printhead voltage, other parameters may be changed, such as driving time per one drive pulse, a time interval of printing, and the like.

The wireless tag reception antenna 119 is connected with the system controller 113, and receives the material temperature data from the thermometer unit 130. Electromagnetic waves are transmitted and received between the wireless tag reception antenna 119 and the thermometer unit 130, so the wireless tag reception antenna 119 can receive the material temperature data wirelessly. The thermometer unit 130 includes a recording material temperature sensor 131 and a wireless tag transmission antenna 132 as data transmitter. The recording material temperature sensor 131 measures the material temperature of the recording material 120. The wireless tag transmission antenna 132 wirelessly transmits the material temperature data to the wireless tag reception antenna 119. For this purpose, a communication system for the reception antenna 119 and the transmission antenna 132 is a type according to the non-contact IC memory, such as wireless tags or RFID (radio frequency identification) tags. At first, the wireless tag reception antenna 119 sends a signal of powering to the thermometer unit 130 with electromagnetic waves as carrier, so that the powering of the thermometer unit 130 is started by use of a power source.

Shortly before the start of printing with the thermal head 114, the system controller 113 causes the wireless tag reception antenna 119 to supply the thermometer unit 130 with power, and start operation of the thermometer unit 130. Thus, the system controller 113 receives the material temperature data from the thermometer unit 130 wirelessly. Then the system controller 113 sends the material temperature data to the voltage correction circuit 142 together with the printhead temperature data.

Figure 12:
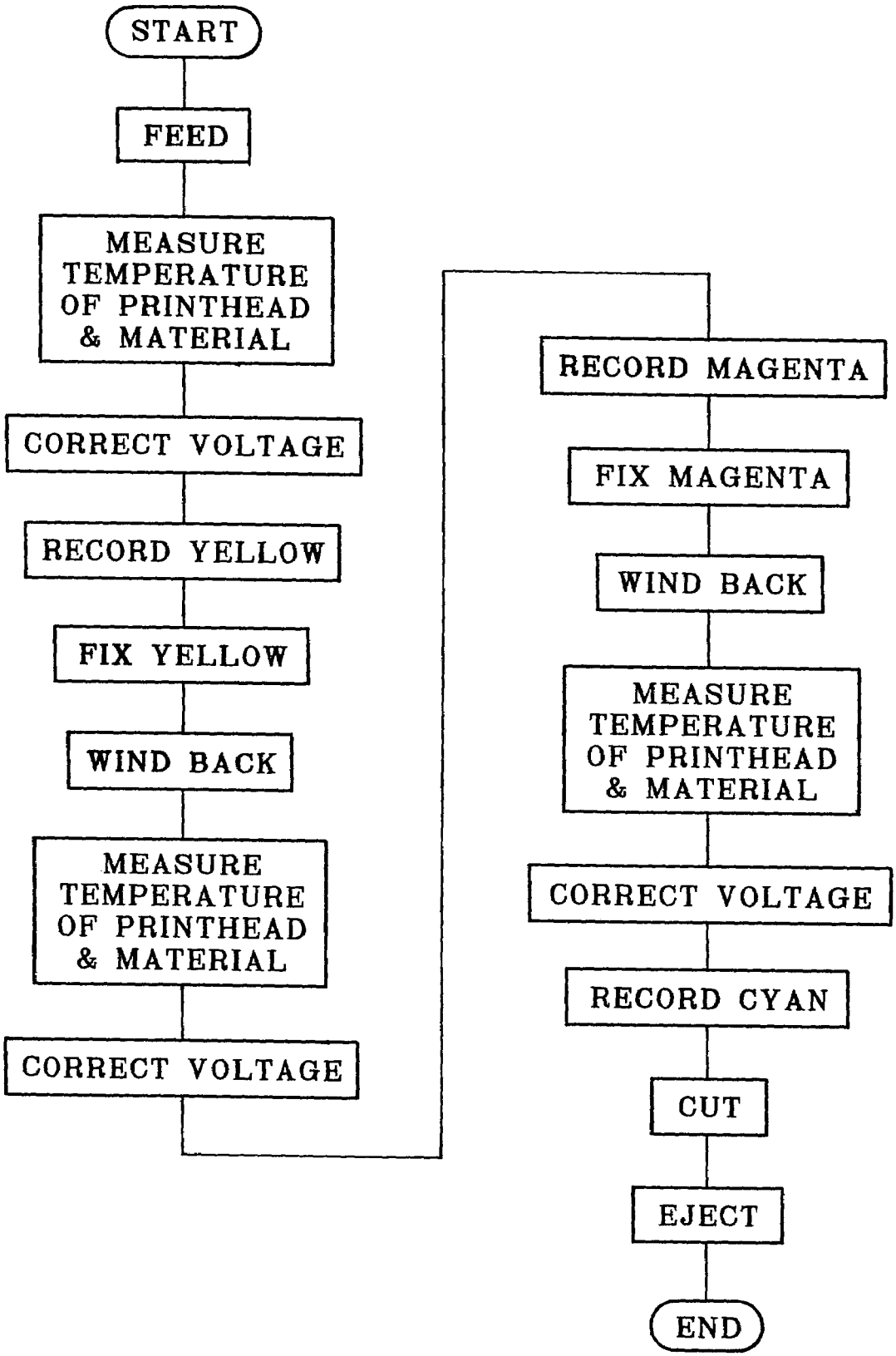
FIG. 12 is a flow chart illustrating a process of correcting a printhead voltage applied to the thermal head.

The operation of the present embodiment is described by referring to the flow in FIG. 12. A command signal is input at first. The recording material 120 starts moving in the moving path in response to the command signal. The recording material 120 being moved is nipped by the feed roller set 111 and moved in the forward direction. When the front edge of the recording material 120 reaches the front edge sensor 116, the system controller 113 starts counting drive pulses input to the stepping motor 112.

When the front edge of the printing region 120*a* of the recording material 120 reaches a heating element array 114*b*, yellow recording is started. For the yellow recording, the printhead voltage for the thermal head 114 is corrected. The material temperature data is transmitted from the thermometer unit 130 to the wireless tag reception antenna 119, and input to the system controller 113. The system controller 113 sends the voltage correction circuit 142 the material temperature data and the printhead temperature data measured by the printhead temperature sensor 114*c*.

According to the two values of the temperature, the voltage correction circuit 142 determines data of the corrected voltage, and sends the same to the printhead driver 118. Also, a line memory 143 stores line image data for lines constituting each frame. The printhead driver 118 receives the data of the corrected voltage and the line image data read from the line memory 143, and drives the thermal head 114.

When the yellow recording is completed, the recorded portion of the recording material 120 is sent to the photo fixer 117, and subjected to the yellow fixation. After this, the unwound portion of the recording material 120 is wound back. The recording material 120 is fed in the forward direction. The front edge of the printing region 120*a* comes again to the thermal head 114. In response to this, the magenta color starts being recorded thermally. For the magenta recording, the printhead voltage is corrected according to the material temperature and the printhead temperature in a manner the same as the yellow recording.

The magenta recording is effected similarly to the yellow recording. After completion of the magenta recording, the printhead voltage is corrected according to the material temperature and the printhead temperature, before the cyan recording is effected. After the three-color recording, the front edge region 120*b* is cut away by the cutter. A recorded portion of the recording material 120 is cut and separated, and ejected to the outside of the thermal printer.

Note that, although the front edge region 120*b* is cut away after the printing operation in the above embodiment, the front edge region 120*b* with the thermometer unit 130 may remain with a print without being cut away. This is effective in simplifying the cutting operation for producing the print.

In the above embodiment, the thermometer unit 130 is incorporated in the recording material 120 between the sheet layers of the support 126, and used for measuring the material temperature. However, the thermometer unit 130 may be combined with an element different from the recording material 120. For example, a thermal printer can be provided with the thermometer unit 130, which can contact the recording material 120 and measure the material temperature. According to a measurement signal output by the thermometer unit 130, the printhead voltage may be corrected. However, a problem may occur in that scratches or damages occur on a surface of the recording material 120 because of the contact of the thermometer unit 130 on the recording material 120. Accordingly, the above-described feature of the embodiment is still preferable in that the thermometer unit 130 is contained in the recording material 120, measures the material temperature, and transmits the material temperature data to the color thermal printer 110 wirelessly.

Figure 13:
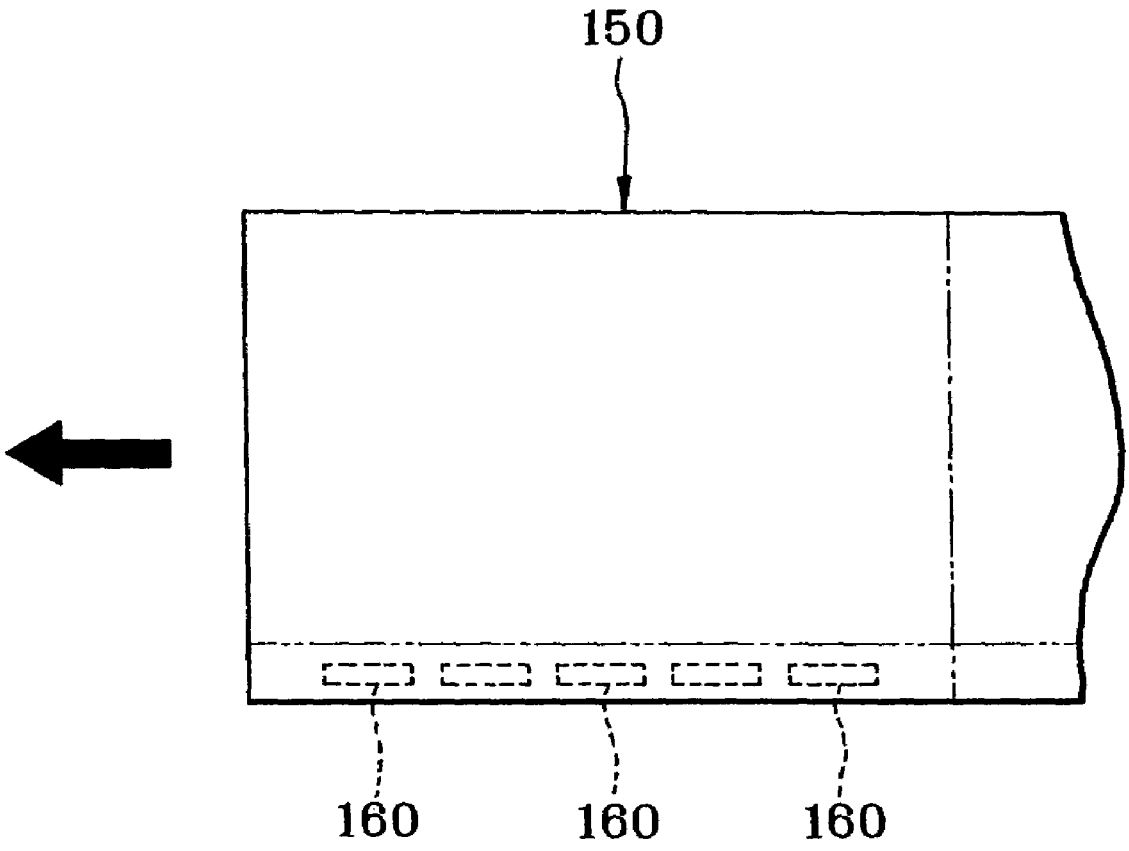
FIG. 13 is a plan, partially broken, illustrating an arrangement of recording material temperature sensors according to another preferred embodiment.

In the above embodiment, the material temperature of the recording material 120 is measured before the start of the printing with the thermal head 114. An image of one frame is recorded at the printhead voltage corrected according to the material temperature of the recording material 120. However, the material temperature may be measured for two or more times in the recording of one frame. The printhead voltage may be corrected for plural times in the recording of one frame. In FIG. 13, a preferred embodiment to this end is illustrated. Color thermosensitive recording material 150 is provided with recording material temperature sensors 160 incorporated therein. While the recording material 150 is moved, temperature of plural portions of the recording material 150 can be measured by the recording material temperature sensors 160. The recording material temperature sensors 160 are arranged in an edge portion along one lateral edge of the recording material 150.

In the above embodiment, the heat energy is corrected according to the parameters including the material temperature and the printhead temperature. However, other parameters may be additionally considered, such as a temperature of the atmosphere or air disposed around the thermal head.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal printer for recording an image on thermosensitive recording material fed in a first direction, said recording material having first and second lateral edges extending in said first direction, said thermal printer comprising:

a thermal head for applying heat to said recording material to record said image by one line, said thermal head having a heating element array of plural heating elements arranged in a second direction crosswise to said first direction, said heating element array having at least one end disposed outside said first lateral edge;

an edge detecting sensor for detecting said first lateral edge;

heating element determination means, responsive to an output from said edge detecting sensor, for determining N edge region heating element included in said heating elements, opposed to said recording material, and disposed close to said first lateral edge, where N is an integer;

a controller for controlling driving of said edge region heating element, so as to suppress color development of said edge region heating element in at least one predetermined line on said recording material.

2. A thermal printer as defined in claim 1, wherein said edge detecting sensor comprises a line sensor having plural pixels arranged at a pitch of arrangement of said heating elements.

3. A thermal printer as defined in claim 2, wherein said heating element array includes outer heating elements disposed outside said first lateral edge, and said controller suppresses driving of said outer heating elements.

4. A thermal printer as defined in claim 3, further comprising a recording material guide mechanism for guiding said second lateral edge.

5. A thermal printer as defined in claim 3, wherein N is in a range of 3–9.

6. A thermal printer as defined in claim 3, wherein said at least one predetermined line comprises plural lines with odd numbers or even numbers as counted serially.

7. A thermal printer as defined in claim 3, wherein said at least one predetermined line comprises M2 adjacent line next to M1 adjacent lines, where Ml is an integer of at least two, and M2 is an integer of at least one.

8. A thermal printer as defined in claim 7, wherein M1 and M2 are determined according to average density in a region in said image associated with said edge region heating element.

9. A thermal printer as defined in claim 7, wherein M1 and M2 are determined according to average density in a portion in said image included in a region associated with said edge region heating element.

10. A thermal printer as defined in claim 1, wherein to suppress color development is to turn off said edge heating element.

11. A thermal printing method of recording an image on thermosensitive recording material fed in a first direction, said recording material having first and second lateral edges extending in said first direction, wherein a thermal head applies heat to said recording material to record said image by one line, said thermal head having a heating element array of plural heating elements arranged in a second direction crosswise to said first direction, said heating element array having at least one end disposed outside said first lateral edge, said thermal printing method comprising steps of:

detecting said first lateral edge;

in response to detecting said first lateral edge, determining N edge region heating element included in said heating elements, opposed to said recording material, and disposed close to said first lateral edge, where N is an integer;

controlling driving of said edge region heating element, so as to suppress color development of said edge region heating element in at least one predetermined line on said recording material.

12. A thermal printing method as defined in claim 11, wherein N is in a range of 3–9.

13. A thermal printing method as defined in claim 11, wherein said at least one predetermined line comprises plural lines with odd numbers or even numbers as counted serially.

14. A thermal printing method as defined in claim 11, wherein said at least one predetermined line comprises M2 adjacent line next to M1 adjacent lines, where M1 is an integer of at least two, and M2 is an integer of at least one.

15. A thermal printing method as defined in claim 13, wherein M1 and M2 are determined according to average density in a region in said image associated with said edge region heating element.

16. A thermal printing method as defined in claim 14, wherein M1 and M2 are determined according to average density in a portion in said image included in a region associated with said edge region heating element.

17. A thermal printer for recording an image on thermosensitive recording material fed in a first direction, said recording material having first and second lateral edges extending in said first direction, said thermal printer comprising:

a thermal head for applying heat to said recording material to record said image by one line, said thermal head having a heating element array of plural heating elements arranged in a second direction crosswise to said first direction, said heating element array having at least one end disposed outside said first lateral edge;

an edge detecting sensor for detecting said first lateral edge;

a heating element determining circuit for determining N edge region heating element included in said heating elements, opposed to said recording material, and disposed close to said first lateral edge, where N is an integer;

a controlling circuit for controlling said N edge region heating element, so as to suppress color development of said N edge region heating element in at least one predetermined line on said recording material.

18. A thermal printer as defined in claim 17, wherein said heating element array includes outer heating elements disposed outside said first lateral edge, and said controller suppresses driving of said outer heating elements.

19. A thermal printer as defined in claim 17, wherein said at least one predetermined line comprises plural lines with odd numbers or even numbers as counted serially.

20. A thermal printer as defined in claim 17, wherein said at least one predetermined line comprises M2 adjacent line next to M1 adjacent lines, where M1 is an integer of at least two, and M2 is an integer of at least one.

21. A thermal printer as defined in claim 17, wherein M1 and M2 are determined according to average density in a region in said image associated with said edge region heating element.

22. A thermal printer as defined in claim 17, wherein to suppress color development is to turn off said edge heating element.

* * * * *